US011077455B2

(12) United States Patent
Fujiwara et al.

(10) Patent No.: US 11,077,455 B2
(45) Date of Patent: Aug. 3, 2021

(54) TRIGGER-TYPE LIQUID SPRAYER

(71) Applicant: YOSHINO KOGYOSHO CO., LTD., Tokyo (JP)

(72) Inventors: Kotaro Fujiwara, Tokyo (JP); Kazuhisa Yoshimura, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/758,380

(22) PCT Filed: Aug. 21, 2018

(86) PCT No.: PCT/JP2018/030881

§ 371 (c)(1),
(2) Date: Apr. 22, 2020

(87) PCT Pub. No.: WO2019/087535

PCT Pub. Date: May 9, 2019

(65) Prior Publication Data

US 2020/0338579 A1 Oct. 29, 2020

(30) Foreign Application Priority Data

Oct. 31, 2017 (JP) ..... JP2017-211130

(51) Int. Cl.
*B05B 11/00* (2006.01)
*B05B 1/12* (2006.01)
*B05B 7/02* (2006.01)

(52) U.S. Cl.
CPC ..... *B05B 11/3009* (2013.01); *B05B 1/12* (2013.01); *B05B 7/02* (2013.01)

(58) Field of Classification Search
CPC ..... B05B 11/3073; B05B 11/3009; B05B 11/3074; B05B 1/12; B05B 7/02
See application file for complete search history.

(56) References Cited

U.S. PATENT DOCUMENTS 3,768,734 A * 10/1973 Anderson, Jr. ..... B05B 11/3077 239/333
4,815,663 A * 3/1989 Tada ..... B05B 11/0032 239/333

(Continued)

FOREIGN PATENT DOCUMENTS

JP 2009-297650 A 12/2009
JP 2015-047552 A 3/2015

(Continued)

OTHER PUBLICATIONS

JP2009297650A with Machine Translation (Year: 2009).*

(Continued)

*Primary Examiner* — Vishal Pancholi
(74) *Attorney, Agent, or Firm* — Oliff PLC

(57) ABSTRACT

A trigger-type liquid sprayer in which a spring member urging an operation lever is less likely to be fatigued. A trigger-type liquid sprayer includes a sprayer main body attached to a container, an operation lever held to be swingable in a front-back direction with respect to the sprayer main body, and a spring member urging the operation lever forward. The spring member includes a fixed part that is located in front of a swing center of the operation lever and is fixed and held to the sprayer main body, and a projection that is located below the fixed part. The operation lever includes an inclined surface that is inclined upward from downward and frontward from backward and is urged by the projection abutting against the inclined surface.

1 Claim, 3 Drawing Sheets

(56) References Cited

U.S. PATENT DOCUMENTS

| | | | | |
|---|---|---|---|---|
| 5,341,965 | A * | 8/1994 | Maas | B05B 11/3011 222/340 |
| 6,267,271 | B1 * | 7/2001 | Tsuchida | B05B 11/3011 222/383.1 |
| 7,413,134 | B2 * | 8/2008 | Tsuchida | B05B 11/3011 239/333 |
| 7,571,836 | B2 * | 8/2009 | Foster | B05B 11/3011 222/340 |

FOREIGN PATENT DOCUMENTS

| | | | |
|---|---|---|---|
| JP | 2015-062886 | A | 4/2015 |
| JP | 2015-063345 | A | 4/2015 |
| JP | 2015-066539 | A | 4/2015 |
| JP | 2017-132518 | A | 8/2017 |
| JP | 2017-170281 | A | 9/2017 |

OTHER PUBLICATIONS

Oct. 2, 2018 International Search Report issued in International Patent Application No. PCT/JP2018/030881.
Mar. 3, 2021 Office Action issued in Chinese Patent Application No. 201880069229.7.
Mar. 3, 2021 Office Action issued in Japanese Patent Application No. 2017-211130.
Apr. 8, 2021 Response filed in Japanese Patent Application No. 2017-211130.
May 6, 2021 Response filed in Chinese Patent Application No. 201880069229.7.

* cited by examiner

TRIGGER-TYPE LIQUID SPRAYER

TECHNICAL FIELD

The present invention relates to a trigger-type liquid sprayer that is attached to a container storing a content liquid and sprays the content liquid by swinging an operation lever in a front-back direction.

BACKGROUND ART

For containers storing a content liquid such as a mold remover, a detergent, an air freshener, a repellent, an agricultural chemical, and a chemical, a trigger-type liquid sprayer has been widely used (for example, see Patent Literature 1). The trigger-type liquid sprayer is attached to a mouth part of the container and sprays the liquid in the container in the form of a straight jet, mist, or foam by actuation of a pump provided in a sprayer main body, in response to swinging of an operation lever in a front-back direction, thereby allowing efficient supply of the content liquid.

As shown in FIG. 3, a conventional trigger-type liquid sprayer 100 includes a sprayer main body 102 attached to a container 101, an operation lever 103 held swingably in a front-back direction with respect to the sprayer main body 102, and a spring member 104 urging the operation lever 103 forward. Here, a projection (spring-side projection 105) is provided on a lower part of the spring member 104, whereas a projection (lever-side projection 106) located in front of the spring-side projection 105 is provided on the operation lever 103. When the operation lever 103 is swung backward, a back end part of the lever-side projection 106 presses a front wall of the spring-side projection 105 to elastically deform the spring member 104, so that the operation lever 103 is urged forward by elastic force generated by the elastic deformation.

CITATION LIST

Patent Literature

Patent Literature 1: JP 2017-170281 A

SUMMARY OF INVENTION

Technical Problem

When the operation lever 103 is swung back and forth, the spring-side projection 105 is moved in a front-back direction together with the lever-side projection 106 because the movement of the spring-side projection 105 in the front-back direction is restricted by the lever-side projection 106. For this reason, when the range in which the operation lever 103 is swung in the front-back direction is to be widened as in a case of spraying a relatively large amount of a content liquid, the spring-side projection 105 is also moved largely in the front-back direction. As a result, the amount of deformation of the spring member 104 is increased and the spring member 104 is easily fatigued.

The present invention has been achieved in order to solve such a problem, and an object of the present invention is to provide a trigger-type liquid sprayer in which a spring member is less likely to be fatigued as compared to a conventional case.

Solution to Problem

The present invention provides a trigger-type liquid sprayer including a sprayer main body attached to a container, an operation lever held to be swingable in a front-back direction with respect to the sprayer main body, and a spring member urging the operation lever forward, the trigger-type liquid sprayer sucking, pressurizing, and pumping a content liquid stored in the container to spray the content liquid to outside by swinging the operation lever in the front-back direction so as to actuate a pump provided in the sprayer main body, in which the spring member includes a fixed part that is located in front of a swing center of the operation lever and is fixed and held to the sprayer main body, and a projection that is located below the fixed part, and the operation lever includes an inclined surface that is inclined upward from downward and frontward from backward and is urged by the projection abutting against the inclined surface.

The inclined surface is preferably a curved inclined surface that is curved in a direction away from the projection.

Advantageous Effects of Invention

The trigger-type liquid sprayer according to the present invention is configured such that the urging force of the spring member acts on the operation lever by the projection provided on the spring member abutting against the inclined surface provided in the operation lever. When the operation lever is swung, the projection abutting against the inclined surface moves backward together with the inclined surface while moving relatively forward with respect to the inclined surface. Consequently, the amount of movement in the front-back direction is reduced as compared to a conventional case, and thus the amount of deformation of the spring member can be reduced. Therefore, the spring member can be less likely to be fatigued as compared to a conventional trigger-type liquid sprayer.

DESCRIPTION OF EMBODIMENTS

Figure 1:
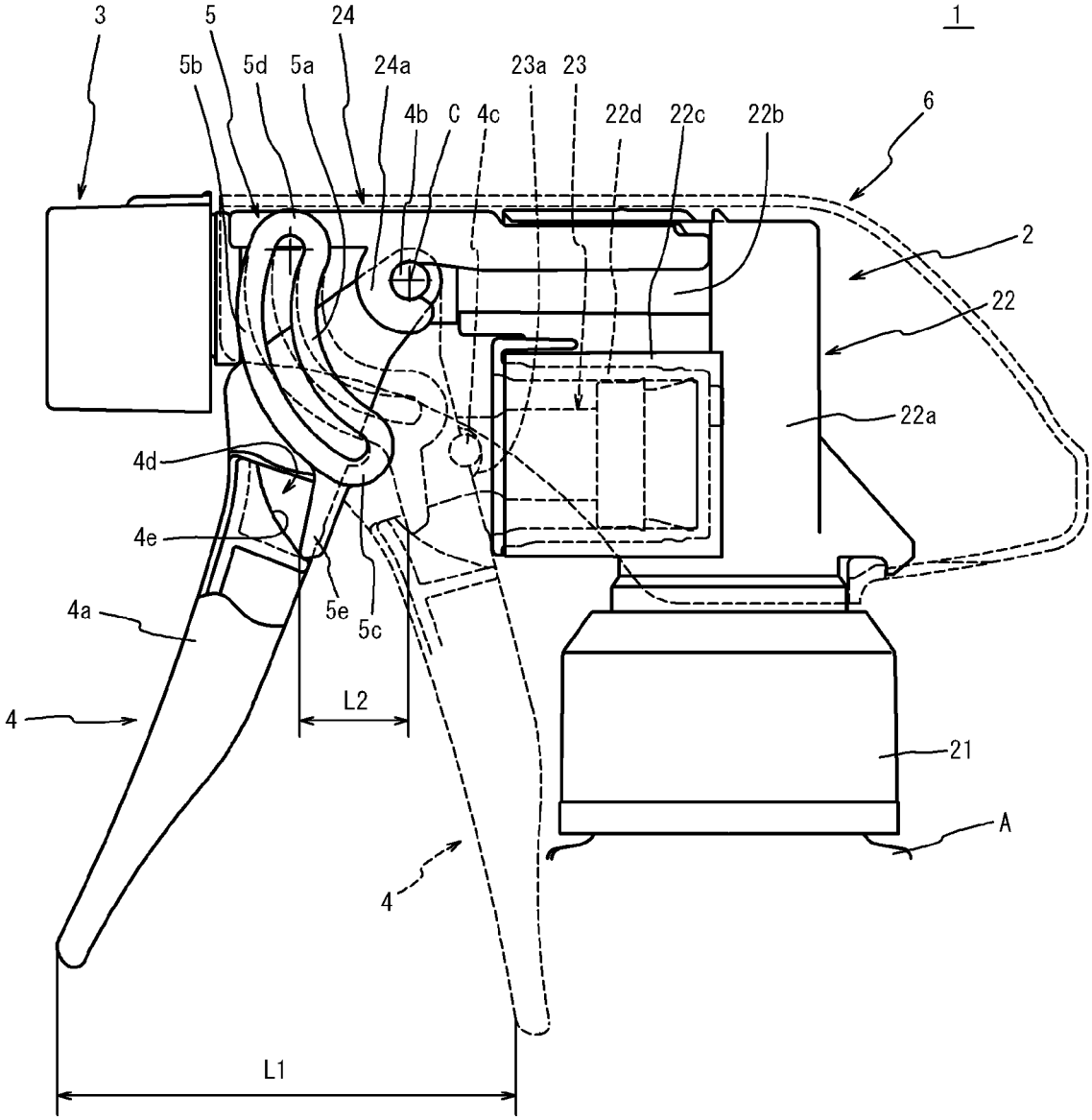
FIG. 1 is a view showing a relationship between an operation lever and a spring member in an embodiment of a trigger-type liquid sprayer according to the present invention.

Hereinafter, an embodiment of a trigger-type liquid sprayer according to the present invention will be described with reference to FIG. 1. In the present specification and the like, □upward□ is a side on which a cover part indicated by reference numeral 24 is disposed with respect to an attachment cap indicated by reference numeral 21 in FIG. 1, and □downward□ is the opposite side. Further, □frontward□ is a side (left side in FIG. 1) on which a nozzle indicated by reference numeral 3 is disposed with respect to a vertical cylinder part indicated by reference numeral 22*a*, and □backward□ is the opposite side (right side in FIG. 1). □Side direction□ is a left-right direction as viewed from the front toward the back (direction orthogonal to drawing in FIG. 1).

Reference numeral 1 shown in FIG. 1 indicates an embodiment of the trigger-type liquid sprayer according to the present invention. The trigger-type liquid sprayer 1 generally includes a sprayer main body 2, the nozzle 3, an operation lever 4, a spring member 5, and a shroud 6.

The sprayer main body 2 includes the attachment cap 21 for fixing and holding the trigger-type liquid sprayer 1 at a mouth part of a container A. Although not shown, a male screw part is provided on an outer peripheral surface of the mouth part of the container A, and a female screw part is provided on an inner peripheral surface of the attachment cap 21. By rotating the attachment cap 21 with respect to the mouth part and screwing the female screw part into the male screw part, the sprayer main body 2 is fixed and held in the container A. In order to fix and hold the sprayer main body 2 in the container A, other means such as an undercut may be adopted.

The sprayer main body 2 also includes a passage part 22 having an internal passage through which a content liquid stored in the container A passes. The passage part 22 includes the vertical cylinder part 22*a* extending upward from downward and a horizontal cylinder part 22*b* extending forward from an upper end of the vertical cylinder part 22*a*. A cylindrical part 22*c* with an open front is provided at an intermediate part of the vertical cylinder part 22*a* in a vertical direction. A cylinder 22*d* is fitted and held into the cylindrical part 22*c*.

A piston member 23 that slides in an air-tight and liquid-tight manner with respect to an inner peripheral surface of the cylinder 22*d* is provided inside the cylinder 22*d*. The cylinder 22*d* and the piston member 23 function as a pump that introduces the content liquid stored in the container A in the internal passage of the passage part 22 and sprays the content liquid to the outside. By moving the piston member 23 in the front-back direction, the content liquid can be sucked, pressurized, and pumped. A connection recess part 23*a* connected to the operation lever 4 is provided at a front end part of the piston member 23.

The sprayer main body 2 also includes the cover part 24 disposed above the horizontal cylinder part 22*b*. A C-shaped bearing part 24*a* with an open back is provided on both sides of the cover part 24.

The nozzle 3 attached to the horizontal cylinder part 22*b* is provided in front of the cover part 24. Although not shown, a spray port for spraying the content liquid having passed through the internal passage of the passage part 22 and an impact plate located at the front of the spray port are provided on a front end part of the nozzle 3. As the content liquid from the spray port collides with the impact plate, the spray form of the content liquid is changed by the impact plate. By appropriately selecting a shape, the content liquid can be sprayed to the outside in the form of a mist or foam. The spray plate is arbitrarily provided, and the content liquid may be sprayed directly from the spray port. Further, the nozzle 3 is provided rotatably with respect to the horizontal cylinder part 22*b*, and can open and close the spray port according to a rotation angle.

Figure 2:
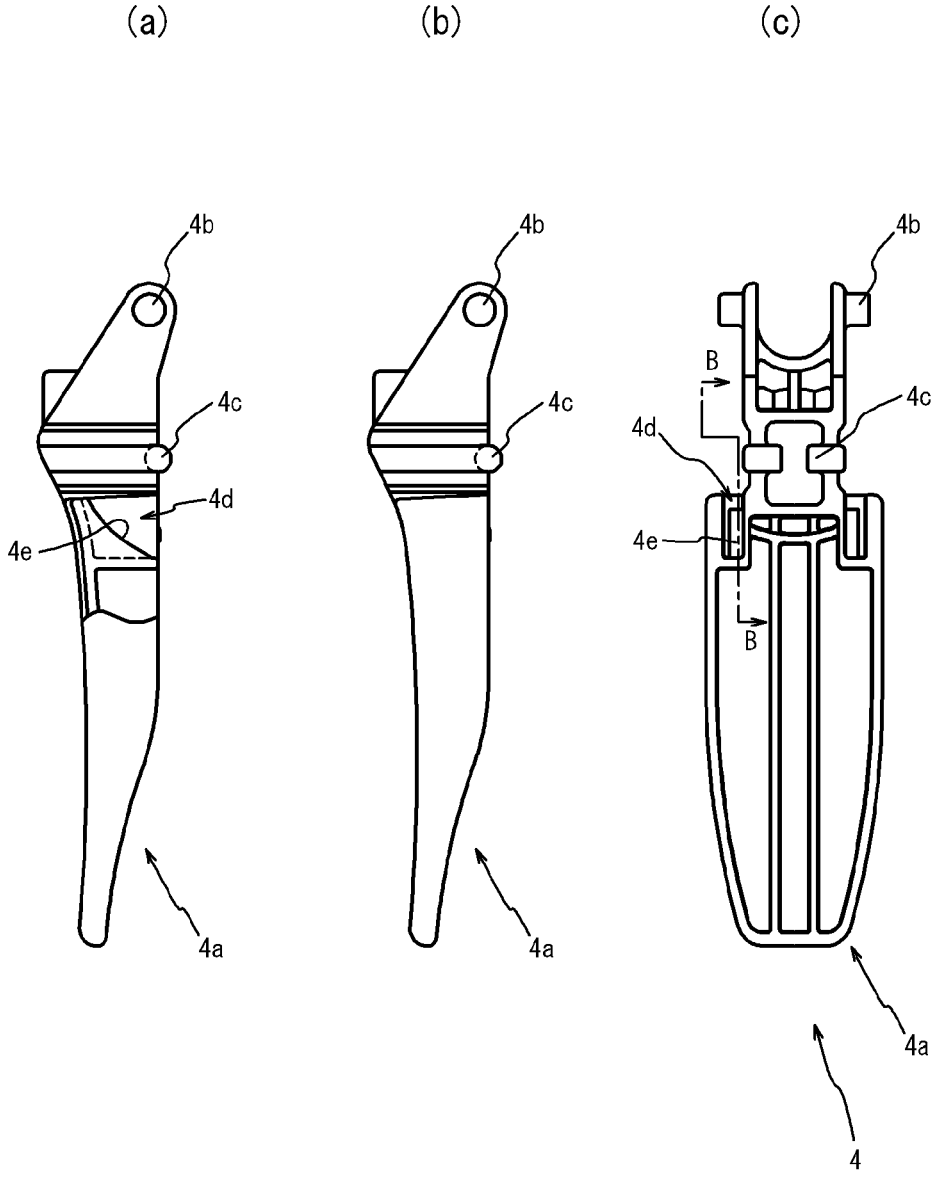
FIG. 2(*a*) is a partial cross-sectional view of the operation lever shown in FIG. 1, taken along a line B-B shown in FIG. 2(*c*), FIG. 2(*b*) is a side view of the operation lever shown in FIG. 1, and FIG. 2(*c*) is a rear view of the operation lever shown in FIG. 1.

The operation lever 4 is attached to the bearing part 24*a* of the cover part 24. The operation lever 4 includes a lever main body part 4*a* that is a part on which a finger is put during an operation. Further, as shown in FIG. 2, a pair of shaft parts 4*b* each having a columnar shape and projecting laterally outward are provided on an upper part of the lever main body part 4*a*. The shaft part 4*b* is supported by the bearing part 24*a* as shown in FIG. 1, and the operation lever 4 can swing in the front-back direction around a center (swing center C) of the shaft part 4*b*. A pair of connection shaft parts 4*c* each inserted into the connection recess part 23*a* of the piston member 23 are provided on a back part of the lever main body part 4*a*.

As shown in FIG. 2, a recess part 4*d* that opens backward is provided in an intermediate part of the operation lever 4 in the vertical direction. An inclined surface 4*e* that is inclined upward from downward and frontward from backward is provided inside the recess part 4*d*. The inclined surface 4*e* of the present embodiment is provided as a curved inclined surface that is curved in a direction away from a projection 5*e* of the spring member 5 to be described later (direction away from shaft part 4*b*). As shown in FIG. 2(*c*), the recess part 4*d* and the inclined surface 4*e* are respectively provided in pairs in the operation lever 4.

The cover part 24 includes paired spring members 5 provided on both sides in front of the bearing part 24*a*. The spring member 5 includes a small-diameter inner curved piece 5*a* and a large-diameter outer curved piece 5*b*, and the inner curved piece 5*a* and the outer curved piece 5*b* are connected by a lower curved part 5*c* and an upper curved part 5*d*. In the spring member 5 of the present embodiment, the upper curved part 5*d* is integrally connected to the cover part 24, and the upper curved part 5*d* functions as a fixed part to be fixed and held to the cover part 24. Further, a projection 5*e* is provided on a lower part of the outer curved piece 5*b* so as to project outward and enter the inside of the recess part 4*d*, and thus abut against the inclined surface 4*e* at its distal end.

The shroud 6 covers most of the sprayer main body 2, and the upper parts of the operation lever 4 and the spring member 5. The shroud 6 of the present embodiment is slid frontward from backward with respect to the sprayer main body 2 to be fitted and held into the sprayer main body 2.

In the trigger-type liquid sprayer 1 having such a configuration, when a finger is put on the lever main body part 4*a* to apply force backward, the operation lever 4 swings backward around the swing center C, and the piston member 23 moves backward by the connection shaft part 4*c* inserted into the connection recess part 23*a*. At this time, the projection 5*e* that abuts against the inclined surface 4*e* moves backward as shown by broken lines in FIG. 1. Consequently, the spring member 5 is elastically deformed so that the inner curved piece 5*a* and the outer curved piece 5*b* are bent. On the other hand, when the application of the force to the lever main body part 4*a* is released, the spring member 5 having been elastically deformed is restored and the restoring force at that time acts on the inclined surface 4*e* via the projection 5*e*. As a result, the operation lever 4 swings forward around the swing center C and the piston member 23 moves forward. As described above, by repeatedly applying and releasing the force to the lever main body part 4*a*, the piston member 23 can move in the front-back direction to actuate the pump, and the content liquid stored in the container A can be sprayed from the spray port of the nozzle 3.

Figure 3:
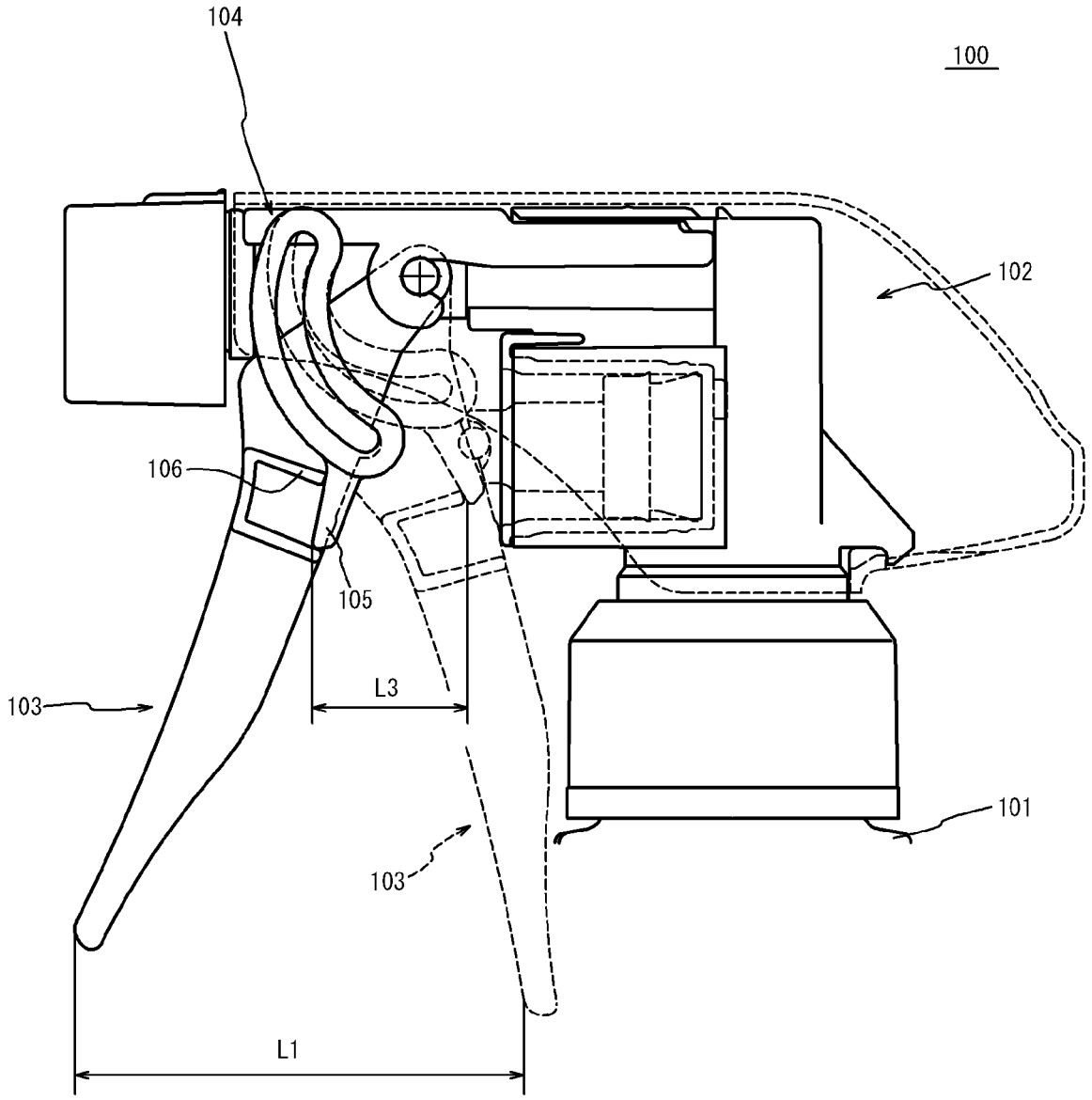
FIG. 3 is a view showing a relationship between an operation lever and a spring member in a conventional trigger-type liquid sprayer.

Meanwhile, when the operation lever 103 is swung in the front-back direction in the conventional trigger-type liquid sprayer 100 shown in FIG. 3, the back end part of the lever-side projection 106 abuts against the front wall of the spring-side projection 105, and thus the spring-side projection 105 moves in the front-back direction together with the lever-side projection 106. Assuming that the amount of a swing movement of the operation lever 103 in the front-back direction is denoted by L1, and the amount of movement of the spring-side projection 105 in the front-back direction is denoted by L3.

On the other hand, when the operation lever 4 is swung in the front-back direction in the trigger-type liquid sprayer 1 shown in FIG. 1, the projection 5*e* abutting against the inclined surface 4*e* moves backward together with the inclined surface 4*e* while moving relatively forward with respect to the inclined surface 4*e*. That is to say, if the operation lever 4 is swung by the amount L1 of movement in the front-back direction like the trigger-type liquid sprayer 100 shown in FIG. 3, the amount L2 of movement of the projection 5*e* in the front-back direction is smaller than the amount L3 of movement of the spring-side projection 105 in the front-back direction shown in FIG. 3. Consequently, in the trigger-type liquid sprayer 1 according to the present invention, the spring member 5 can be less fatigued than in the conventional trigger-type liquid sprayer 100. As the amount of deformation of the spring member 5 is reduced, the force required to swing the operation lever 4 backward can also be reduced.

While the specific embodiment of the trigger-type liquid sprayer according to the present invention has been described above, the trigger-type liquid sprayer according to the present invention is not limited to the above-described embodiment, and also includes various modifications made within the scope of the claims. For example, the inclined surface 4*e* is described as a curved inclined surface that curves in the direction away from the projection 5*e* in the present embodiment. However, for example, the inclined surface 4*e* may be curved in a direction approaching the projection 5*e*, or may be curved in an S shape obtained by combining these curves. Alternatively, the inclined surface 4*e* does not need to be curved, and may be a straight inclined surface. Further, the structures of the internal passage through which a content liquid passes and the pump provided in the sprayer main body 2 are not limited to those in the above-described embodiment, and other structures may be employed.

REFERENCE SIGNS LIST

1 trigger-type liquid sprayer
2 sprayer main body
3 nozzle
4 operation lever
4*a* lever main body part
4*b* shaft part
4*c* connection shaft part
4*d* recess part
4*e* inclined surface
5 spring member
5*a* inner curved piece
5*b* outer curved piece
5*c* lower curved part
5*d* upper curved part (fixed part)
5*e* projection
21 attachment cap
22 passage part
22*a* vertical cylinder part
22*b* horizontal cylinder part
22*c* cylindrical part
23 piston member
23*a* connection recess part
24 cover part
24*a* bearing part
A container
C swing center

The invention claimed is:

1. A trigger-type liquid sprayer comprising: a sprayer main body attached to a container; an operation lever held to be swingable in a front-back direction with respect to the sprayer main body; and a spring member urging the operation lever forward, the trigger-type liquid sprayer sucking, pressurizing, and pumping a content liquid stored in the container to spray the content liquid to outside by swinging the operation lever in the front-back direction so as to actuate a pump provided in the sprayer main body, wherein the spring member includes a fixed part that is located in front of a swing center of the operation lever and is fixed and held to the sprayer main body, and a projection that is located below the fixed part, the operation lever includes an inclined surface that is inclined upward from downward and frontward from backward and is urged by the projection abutting against the inclined surface, and the inclined surface is a curved inclined surface that is curved in a direction away from the projection.

* * * * *